US005187963A

United States Patent [19]

Sutton, Jr. et al.

[11] Patent Number: 5,187,963

[45] Date of Patent: Feb. 23, 1993

[54] TUBE BENDING DIE

[75] Inventors: Fredrick E. Sutton, Jr., Walker; Robert N. Winegar, Sparta, both of Mich.

[73] Assignee: Moiron, Sparta, Mich.

[21] Appl. No.: 897,885

[22] Filed: Jun. 12, 1992

[51] Int. Cl.[5] ..... B21D 7/04

[52] U.S. Cl. ..... 72/159; 72/157; 72/387

[58] Field of Search ..... 72/149, 157, 159, 158, 72/217, 219, 459, 387

[56] References Cited

U.S. PATENT DOCUMENTS

| | | | |
|---|---|---|---|
| 1,533,443 | 4/1925 | Miller | 72/159 |
| 1,901,762 | 3/1933 | Meyer | 72/159 |
| 1,935,604 | 11/1933 | Abramson et al. | 72/157 |
| 3,545,247 | 12/1970 | Fazzumi | 72/149 |
| 5,142,895 | 9/1992 | Schuchert | 72/149 |

*Primary Examiner*—Lowell A. Larson
*Assistant Examiner*—Michael J. McKeon
*Attorney, Agent, or Firm*—Price, Heneveld, Cooper, Dewitt & Litton

[57] ABSTRACT

A bending die for forming a 180° bend in a tube includes a center die and a shiftable block pivotally mounted to the center die grooves are defined on opposing sides of the center die and shiftable block for supporting the tube while being bent. The grooves have a C-shaped cross section for receiving and holding the tube during the bending process, but which grooves create an interference condition trapping the bent tube in a plane defined by the grooves. The shiftable block is pivotally connected to the center die and movable between a bend-forming position where the shiftable block forms an upper part of the groove along the one opposing side and part of the end, and a tube-release position where the shiftable block is removed from the one opposing side. The bending die also includes a clamp die that both clamps the tube to the center die and also holds the shiftable block to the center die while the tube is being bent, but which is movable to release the shiftable block. This arrangement allows the shiftable block to be moved to the tube-release position by rotating the bent tube abuttingly against the shiftable block. Once the bent tube clears the shiftable block, the shiftable block is returned to the bend-forming position by gravity, whereafter the part can be removed or indexed so that additional 180° bends can be formed on the bending die.

22 Claims, 3 Drawing Sheets

TUBE BENDING DIE

BACKGROUND OF THE INVENTION

The present invention relates to a bending die for forming a bend in a tube, and in particular to a bending die with a release feature to facilitate removing the tube from the bending die after forming the bend.

Bending dies are commonly used to form bends in tubes so that the tubes do not collapse when forming the bends, but rather take on the particular shape desired. Typically, the bending dies have a groove formed in one or more sides of the bending die to hold the tube while the bend is being formed, the groove having a semicircular shape that supports the cross-sectional shape of the tube around the inside of the bend to prevent the tube from collapsing.

However, tubes requiring one or more 180° bends present special problems. For example, since the groove extends onto opposing sides of the bending die in order to form the 180° bend, the tube becomes deadlocked in the groove once the 180° bend is formed. Thus, the tube can only be removed from the bending die by sliding the bent tube linearly off an end of the bending die. However, sliding the bent tube linearly off an end of the bending die is time consuming and slows production, and further creates a cumbersome and inefficient unloading process. Still further, as additional 180° bends are formed, the portion of the tube already formed may interfering strike the backside of the bending die or the bending press as the bent tube is being linearly removed, thus preventing the machine from making a finished part in a single continuous process.

One known bending die for making a bend in a tube has an upper die half and a lower die half adapted to be manually disassembled and split apart after forming the bend so that the bent tube can be removed. This known bending die is disclosed in the Information Disclosure Statement submitted herewith. However, the manual assembly/disassembly of the die halves for each bend is labor intensive and time consuming. Despite this, the manual operation continues to be used since automating the split die arrangement has not been considered practical. For example, automation takes up space around the bending dies and creates zones of interference that are difficult or impossible to work around where the tube is manipulated back and forth to form multiple bends. Further, automating the split die arrangement has been considered economically prohibitive since automation is expensive to purchase and maintain, and further often requires complex and expensive controls, which automation and controls are generally not useable on other jobs.

Thus, an improved bending die is desired for solving the aforementioned problems.

SUMMARY OF THE INVENTION

The present invention includes a bending die for forming a bend of about 180° or more in a tube. The bending die includes a center die having opposing sides and a bend forming end connecting the opposing sides, the opposing sides including grooves defining a plane. The bend forming end is adapted to form a bend of about 180° in the tube with the grooves being adapted to support the tube while the bend is being formed, the grooves creating an interference condition trapping the bent tube in the plane defined by the grooves. A shiftable block is movably connected to the center die and movable between a bend-forming position where the shiftable block forms an upper part of the groove along one of the opposing sides, and a tube-release position where the shiftable block is removed from the one opposing side. A clamp die is associated with the center die and shiftable block, the clamp die being movable between a clamping position to hold the shiftable block to the center die in the bend-forming position while the tube is being bent, and a release position to release the shiftable block so that the bent tube can be released from the interference condition by moving the bent tube against the shiftable block to move same to the tube release position.

The present invention includes several advantages over known art. The bending die provides a relatively non-complex mechanism for releasing a bent tube from a center die after forming a bend of about 180° therein, but without the need for substantial capital investment in automation or controls that are not part of a typical bending press. Further, the mechanism of the preferred embodiment is mechanical in nature and can be maintained by ordinary die tryout methods. Still further, the collet of the bending machine which holds the straight base end of the tube can be used to rotatingly move the bent tube out of interfering engagement with the center die, thus allowing the collet to index the tube to successive bend locations without any manual intervention. Thus the present invention allows the bending process to be performed with substantially improved production cycle times. For example, the cycle time for making the part shown in FIG. 2 has been reduced by over 75% by using the center die of the preferred embodiment over the method previously used.

These and other features, advantages and objects of the present invention will be further understood and appreciated by those skilled in the art by reference to the following specification, claims and appended drawings.

DETAILED DESCRIPTION OF THE PREFERRED EMBODIMENT

Figure 3:
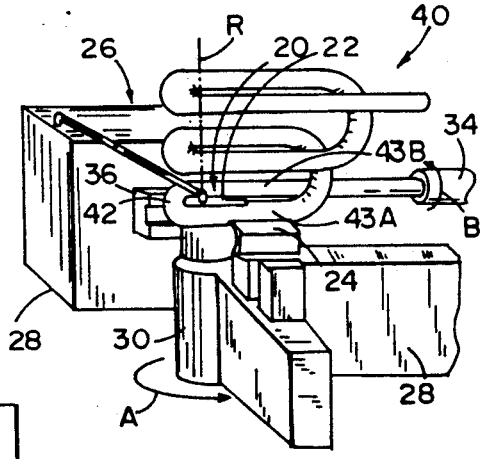
FIG. 3 is a tube bending machine utilizing the bending die shown in FIG. 1.

For purposes described herein, the terms "upper," "lower," "right," "left," "rear," "front," "vertical," "horizontal," and derivatives thereof shall relate to the invention as oriented in FIG. 3 with the machine collet being located in the rear. However, it is to be understood that the invention may assume various alternative orientations, except where expressly specified to the contrary. It is also to be understood that these specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting unless the claims expressly state otherwise.

A bending die 20 embodying the present invention includes a center die 22 (FIG. 1) and a clamp die 24 (FIGS. 3 and 12) that are adapted for making multiple 180° bends in a tube such as the illustrated heat exchanger tube 40 with bends 42 and bend-adjacent tubular straight portions 43 (FIG. 2), portion 43A being the leading tube portion ahead of the particular bend 42 to be formed and portion 43B being the trailing tube portion behind the particular bend 42. Bending die 20 is contemplated to be particularly useful where an interference condition between a bent tube and the bending die would otherwise make the bending process inefficient by requiring excessive manipulation of the part and/or disassembly of the bending die to avoid the interference condition.

Figure 12:
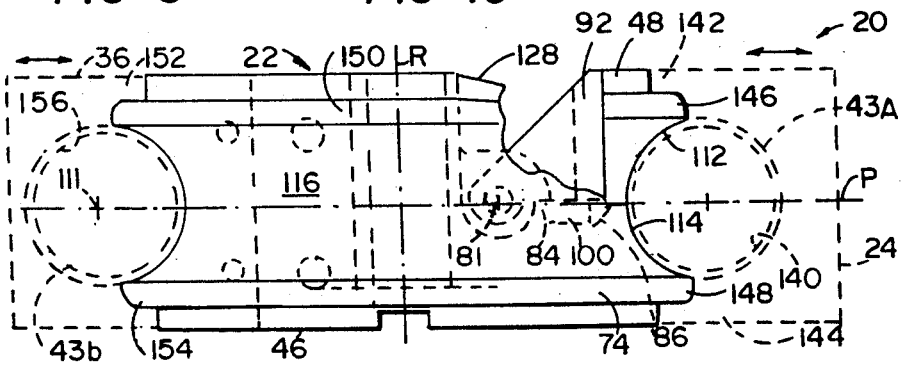
FIG. 12 is an end view of the center die with a clamp die schematically shown as holding the shiftable block in a bend-forming position on the center die, which position is held during the bending process.

Bending die 20 is constructed for use on a tube bending machine 26 (FIG. 3). Bending machines 26 are generally known in the art, and hence machine 26 is described only as necessary hereinafter. Machine 26 includes a stationary portion 28 including a main pivot 30, and a movable bending arm 32 pivotally mounted on the main pivot 30, main pivot 30 defining an axis of rotation "R". Center die 22 is operably mounted to the top of arm 32 at main pivot 30 for rotation with arm 32. Clamp die 24 is also operably mounted to arm 32 at a location spaced from center die 22 and in a position adjacent but "downstream" of the bend-forming side of center die 22, clamp die 24 being adapted to hold tube leading portion 43A against center die 22. Machine 26 further includes a machine collet 34 for holding and manipulating tube 40 during the forming of tube 40, collet 34 being offset somewhat from axis "R" but being generally aligned with the "upstream" side of center die 22. A secondary clamp die 36 is located on machine 26 adjacent main pivot 30 and center die 22, secondary clamp die 36 being adapted to operably hold the tube trailing portion 43B of tube 40 on the collet-side of center die 22 against center die 22 during bending (FIG. 12). Machine 26 further includes various standard controls and actuators (not shown) to control the movement of arm 32 as arm 32 rotates about main pivot 30, and to control the movement of clamp dies 24 and 36 as they clamp and release tube 40 from center die 22. Further, the machine 26 includes controls and hardware for feeding and rotating collet 34 and for moving secondary die 36 forwardly as tube 40 is wrappingly bent around center die 22.

Figure 5:
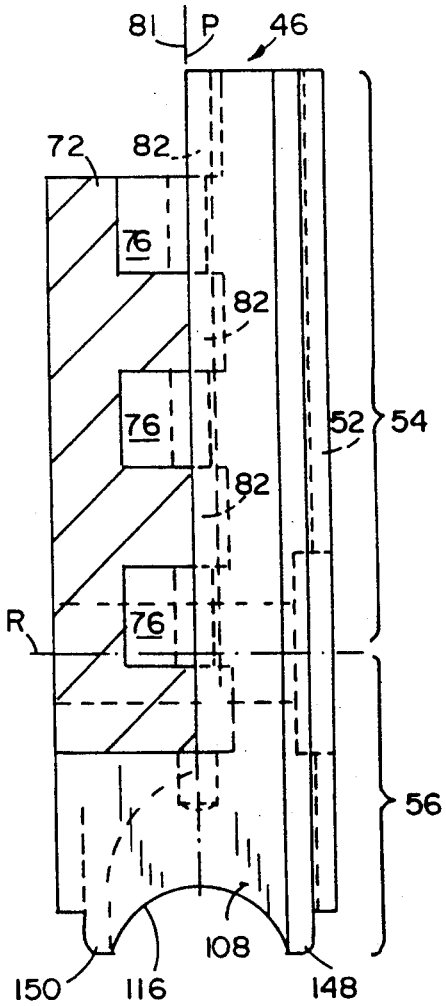
FIG. 5 is a side view of the main block shown in FIG. 4.
Figure 6:
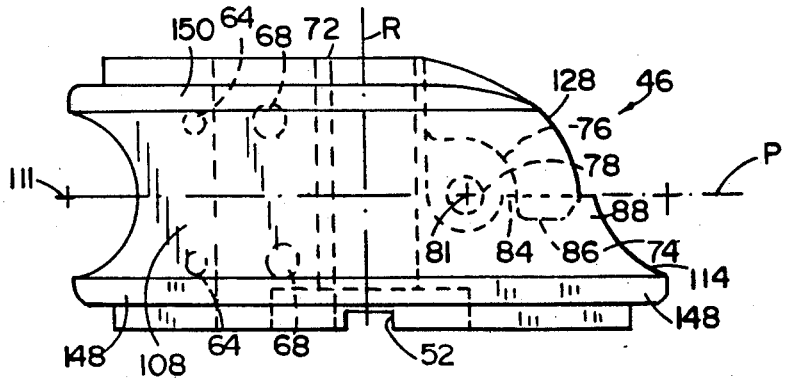
FIG. 6 is an end view of the main block shown in FIG. 4.

The present invention lies primarily in the center die 22 and components related thereto. Center die 22 (FIG. 1) includes a main block 46 and a shiftable block 48, with main block 46 and shiftable block 48 combining to define a U-shaped groove 50 around center die 22 for receiving and holding the tube 40 during the forming of bend 42. Main block 46 (FIGS. 4–6) of center die 22 is generally J-shaped and includes an offset elongated leg 54 joined to a disk-shaped semicircular bend-forming end 56. A pivot hole 58 is located centrally on forming end 56 at the base of leg 54, pivot hole 58 extending perpendicularly to a horizontal plane "P" that extends centrally through main block 46. Pivot hole 58 is adapted to receive an axle-like stud (not shown) for retaining main block 46 to bending machine arm 32 on axis "R". A square channel 52 extends crosswise the length of main block 46 through hole 58 on the lower side of main block 46, channel 52 serving to receive a key (not shown) for keying main block 46 to machine arm 32 so that same move as a unit together during operation of arm 32.

A tail block 60 (FIGS. 1 and 7–8) is adapted to engage the concave portion of main block 46 along the rear side of semicircular bend-forming end 56. Tail block 60 is positively located on end 56 by two locator pins 62 that extend from tail block 60 and engage locator holes 64 in end 56. Tail block 60 further includes a pair of attachment holes 66 for receiving machine bolts 65 which extend through holes 66 into threaded holes 68 in forming end 56. Tail block 60 also includes an outer edge 67 that aligns with the outer edge of bend-forming end 56 and forms a trailing portion of groove 50 for receiving tube trailing portion 43B. Outer edge 67 forms a slight angle with respect to leg 54 so that tube 40 can be given a slight over-bend when forming bend 42 around center die 22, with tube 40 springing back to a 180° bend after being released. Tail block 60 includes a notch 69 for abuttingly engaging a block 69A on main block 46, block 69A providing support around pivot axis "R" on main block 46.

Figure 4:
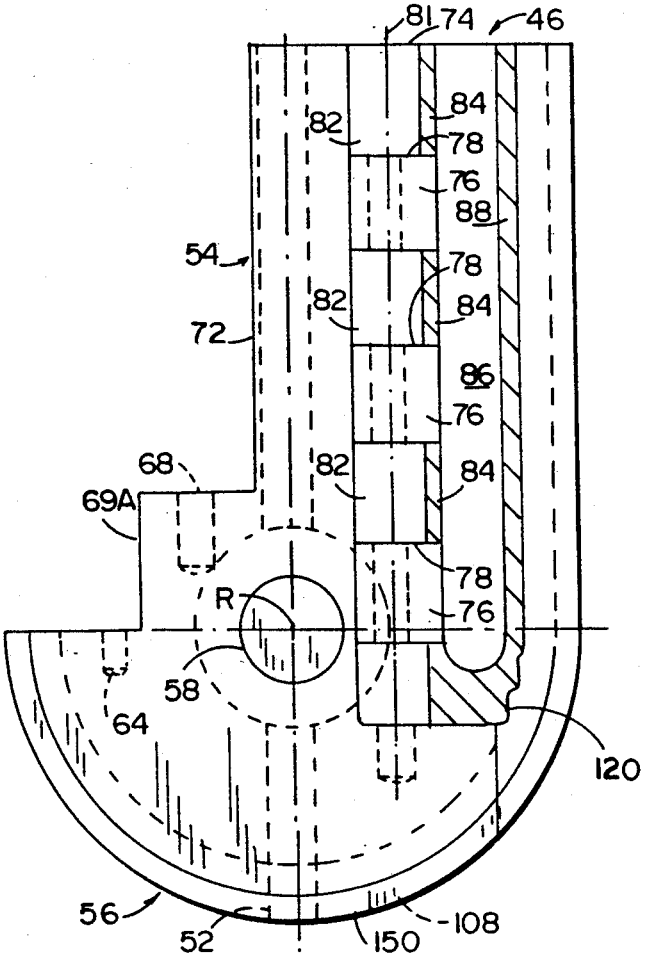
FIG. 4 is a plan view of a main block of the center die shown in FIG. 1.

Offset leg 54 (FIGS. 4–6) includes a longitudinal section 72 and a laterally extending shelf 74 protruding outwardly along the outside edge of the longitudinal section 72. Three spaced hinge supports 76 are positioned along the outside of longitudinal section 72 on shelf 74, each hinge support 76 including a hole 78. Holes 78 are aligned with each other for receiving a pivot pin 80 (FIG. 1) to pivotally connect shiftable block 48 to main block 46, pivot pin 80 defining an axis of rotation 81 for shiftable block 48. Ridges 84 extend longitudinally on shelf 74 interconnectingly between hinge supports 76, and define recesses 82 between hinge supports 76, the recesses 82 being bounded by longitudinal section 72 and ridge 84. A second ridge 88 extends parallel to ridge 84 and with shelf 74 defines a channel 86. In FIG. 4, the shading lines are added to more clearly define plane "P" on shelf 74, which plane "P" divides groove 50 into equal upper and lower parts.

Figure 9:
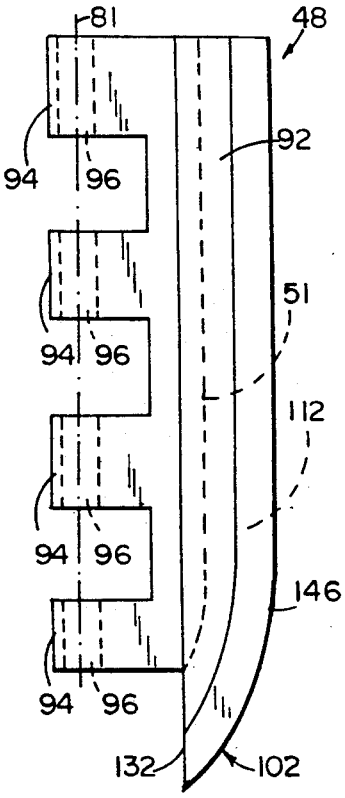
FIG. 9 is a plan view of a pivotally shiftable block for the center die shown in FIG. 1.

Movable block 48 (FIGS. 1 and 9–11) is an elongated member adapted to mateably set on shelf 74 of main block 46. Movable block 48 includes an elongated central shaped member 92 that extends a length equal to leg 54 and is adapted to mateably engage shelf 74 on leg 54. Hinge supports 94 extend laterally inwardly from member 92 and are spaced to mateably slide between hinge support 76 and be located in part in recesses 82. Hinge supports 94 each include a transverse hole 96 that aligns with aligned holes 78, thus permitting pivot pin 80 to securely pivotally interconnect shiftable block 48 to main block 46 so that shiftable block 48 pivots on axis 81. Notably, hinge supports 94 include an angled upper surface 98 (FIG. 11) that provides clearance as shiftable block 48 is rotated toward the raised tube-release position (FIG. 13) from the lowered bend-forming position (FIG. 12). An elongated rib-like protrusion 100 extends downwardly from shaped elongated member 92, protrusion 100 being adapted to engage channel 86 when shiftable block 48 is in the lowered position so that rib-like protrusion 100 can draw support from ridge 84 (FIG. 12) as tube 40 is bent therearound and clamp die 24 and tube leading portion 43A press against same. Also, shaped elongated member 92 extends the length of offset leg 54 and includes a laterally extending tooth-like protrusion 102 (FIG. 9) that extends into a part of the area of forming end 56, as discussed below.

U-shaped groove 50 (FIG. 1) extends around three sides of center die 22 and includes a groove bottom 51 that lies on central plane "P". Groove 50 adapts center die 22 to securely receive and hold tube 40 during the bending thereof: U-shaped groove 50 has an outwardly facing concave U-shaped cross section, groove 50 including first, second and third groove portions 106, 108 and 110 that extend along the combination of J-shaped leg 54 and shiftable block 48, bend-forming end 56, and outer edge 67 of tail block 60, respectively. First groove portion 106 (FIG. 12) has an upper half defined by a concave arcuate surface 112 on shaped member 92 of shiftable block 48 and a lower half defined by a matching concave arcuate surface 114 on shelf 74 of main block 46. First groove portion 106 (FIG. 11) extends the length of offset leg 54 and forms a substantially linear support for the leading leg portion 43A of tube 40 so that leading leg portion 43A remains straight during the bending of tube 40. Significantly, arcuate surface 112 on shiftable block 48 forms the entire upper half of groove 50 along all of first groove portion 106.

Figure 10:
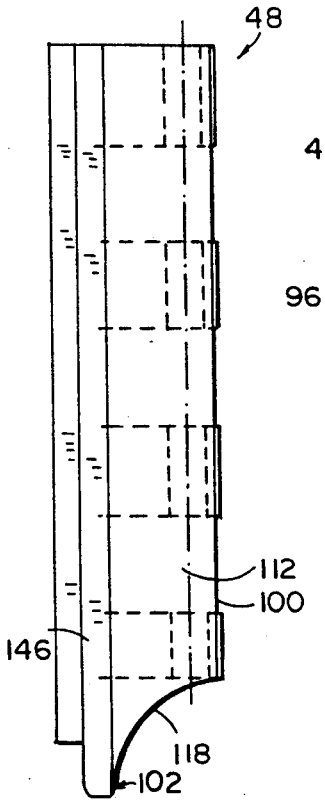
FIG. 10 is a side view of the shiftable block shown in FIG. 9.
Figure 11:
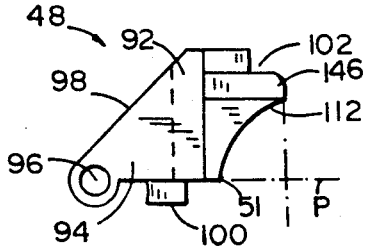
FIG. 11 is an end view of the shiftable block shown in FIG. 9.

Second groove portion 108 of groove 50 extends around bend-forming end 56 and is primarily defined by a concave arcuate surface 116 on forming end 56 of main block 46 (FIG. 5), but also is defined in part by concave arcuate surface 118 located on tooth-like protrusion 102 of shiftable block 48 (FIGS. 10 and 11). In particular, arcuate surface 118 lies adjacent arcuate surface 112 and forms a part of second groove portion 108 adjacent first groove 106. Arcuate surface 118 is bounded on an inner side by a vertical plane 132 (FIG. 9) which is slightly inboard of groove bottom 51, plane 132 being located inboard of bottom 51 so that it provides additional clearance for tube 40 as tube 40 is being released.

Surfaces 116 and 118 define the bend to be placed into tube 40. In the example shown, surfaces 116 and 118 include vertical ridges 120 (FIG. 4) which are located in a spaced array fully around bend-forming end 56, ridges 120 causing multiple depressions or undulations 122 to be formed on the material on the inner diameter of tube bend 42, such as along groove bottom 51. These ridges 120 assist in forming a predictable displacement of material along bend 42 as tube 40 is deformed to form bend 42. Advantageously, undulations 122 in tube bend 42 cause turbulent flow of gases through tube 40 which improves the performance of tube 40 while in service. However, undulations 122 also add to the interference experienced between bent tube 40 and center die 22 after the 180° bend 42 has been formed. Notably, ridges 120 extend generally perpendicular to axis 81 upon which shiftable block rotates.

Figure 1:
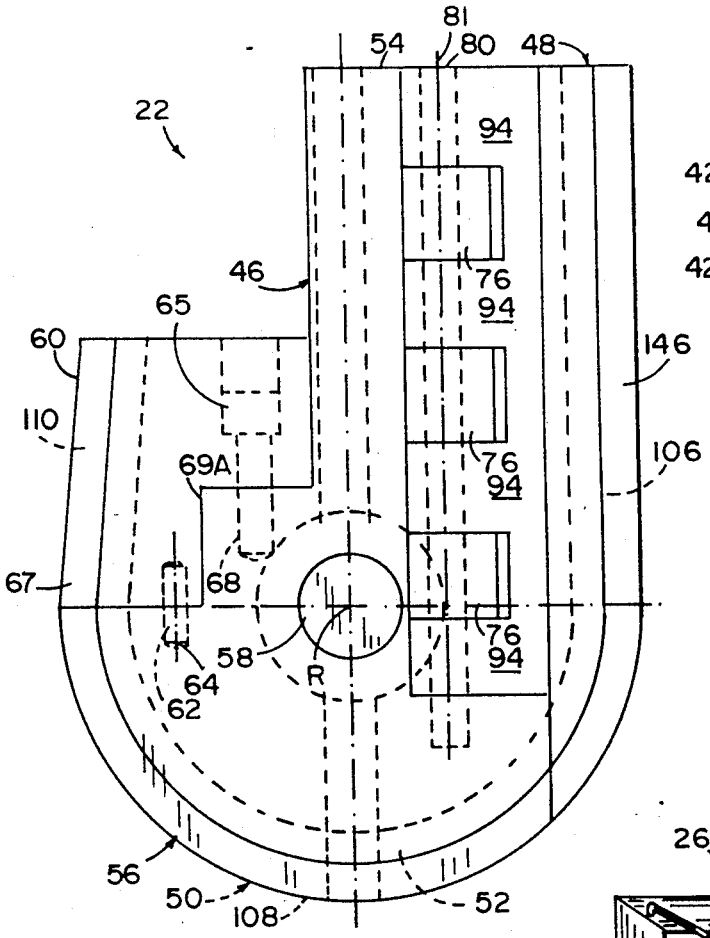
FIG. 1 is a plan view of a center die of a bending die embodying the present invention.
Figure 2:
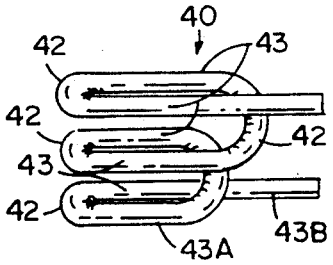
FIG. 2 is a tube including multiple 180° bends, the tube being illustrative of a part manufacturable by the bending die shown in FIG. 1.
Figure 7:
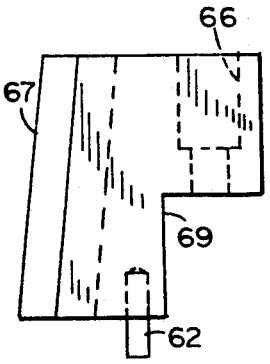
FIG. 7 is a plan view of a tail block for the center die shown in FIG. 1.
Figure 8:
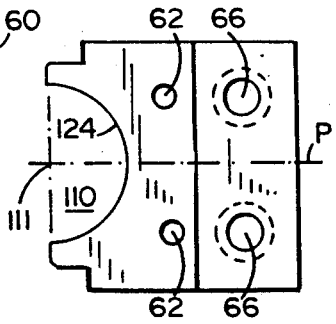
FIG. 8 is an end view of the tail block shown in FIG. 7.

Third groove portion 110 forms a substantially linear support for the trailing leg portion 43B of tube 40 (FIGS. 1 and 7–8). Third portion 110 is defined by concave-shaped arcuate surface 124 located on tail block 60. Third portion 110 extends somewhat parallel to first portion 106, but is oriented at a slight angle inwardly so that the tube bend 42 can be "over-bent" slightly beyond 180° during the bending process so that tube bend 42 springs back to the desired 180°. once released. Trailing leg portion 43B defines an axis 111 (FIGS. 12–13) when in third groove 110.

Movable block 48 is constructed so that it moves freely on pivot pin 80 so that shiftable block 48 can be abuttingly moved to the raised tube-release position by tube 40 (FIG. 13), but also so that shiftable block 48 drops by gravity to the lowered bend-forming position (FIG. 12) once tube 40 has been moved past center die 22. As viewed in FIG. 6, main block 46 includes an arcuately shape corner surface 128. Corner surface 128 is shaped so that protrusion 102 of movable block 48 can be freely rotated past corner surface 128 as shiftable block 48 is moved to the tube-release position about axis 81. In particular, corner surface 128 is defined as follows. As tube leading leg portion 43A is rotated by machine collet 34 about axis 111 out of first groove portion 106 (FIG. 13), leg portion 43 defines an arcuate surface 130. By extending arcuate surface 130 linearly forwardly toward bend-forming end 56, an extended zone of interference is defined. Corner 128 lies inwardly of the extended zone of interference defined by arcuate surface 130 with enough clearance so that tooth-like protrusion 102 does not interfere with any material on main block 46 as shiftable block 48 is moved past corner surface 128.

Optimally, the axis of rotation 81 for shiftable block 48 is located on the plane "P" defined by the central axis of tube portions 43A, 43B so that shiftable block 48 pivots out of the zone of interference as quickly as possible as shiftable block 48 is pivoted upwardly. This location also optimizes the distribution of stresses transmitted to movable block 48 as bend 42 is formed in tube 40.

Clamp die 24 is adapted to engage main block 46 and shiftable block 48 to retain shiftable block 48 in the operative position against main block 46 while a particular bend 42 is being formed in tube 40. FIG. 12 shows the position of center die 22 and clamp dies 24 and 36 after the bend 42 has been formed in tube 40, but before the pressure on clamp dies 24 and 36 has been released. Clamp die 24 includes a C-shaped member with an arcuate center surface 140 for clampingly holding tube leading portion 43A against center die 22, and further includes an upper rim 142 and a lower rim 144 for gripping an upper lip 146 on shiftable block 48 and an opposing lower lip 148 on main block 46, respectively, lips 146 and 148 extending parallel to groove 50 above and below groove 50 on blocks 46 and 48. By engaging opposing lips 146 and 148, clamp die 24 positively holds shiftable block 48 in the lowered bend-forming position while bend 42 is being formed in tube 40.

Main block 46 further includes an upper lip 150 that extends in-line with lip 146 on shiftable block 48. Upper lip 150 and lower lip 148 form opposing lips that extend in parallel around main block 46 above and below groove 50. Secondary clamp die 36 includes upper and lower opposing rims 152 and 154 for engaging lips 150 and 148, respectively, and also includes an arcuate center surface 156 for clampingly engaging tube trailing portion 43B in second and third groove portions 108 and 110.

The operation of machine 26 and bending die 20 are described as follows. Arm 32 is rotated in a direction opposite direction "A" in FIG. 3 so that clamp die 24 and secondary clamp die 36 are positioned adjacent each other and positioned opposite center die 22 in a ready position. A straight section of tube 40 is placed in collet 34 between clamp dies 24, 36 and center die 22 in first groove portion 106. Clamp die 24 is then clamped against center die 22 with clamp die rims 142 and 144 positively engaging shiftable block lip 146 and main block lip 148 to retain shiftable block 48 in the bend-forming position. Arm 32 is then rotated about main pivot 30 in the direction "A", with clamp die 24 rotating with arm 32 so as to form a bend 42 in the tube 40. At the same time, clamp die 36 is fed forwardly supporting tube 40 against second groove portion 108 on bend-forming end 56 until clamp die 36 gradually comes into engagement with center die 22 along third groove portion 110 (FIG. 12). The pressure on clamp dies 24 and 36 is released once bend 42 is formed so that arm 32 can be returned to the ready position and the tube 40 can be indexed to the next bend location.

Figure 13:
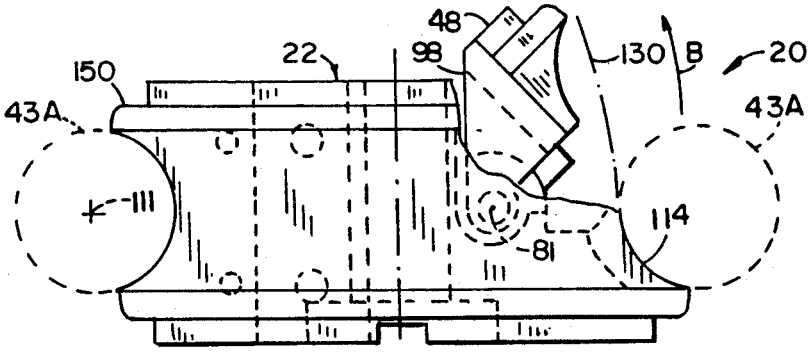
FIG. 13 is an end view of the center die with the shiftable block shown as pivoted to a tube-release position.

Once bend 42 is fully formed, the pressure is released from clamp dies 24 and 36, and at least clamp die 24 is moved away. Collet 34 then linearly advances tube 40 forwardly a short distance so that tube bend 42 clears the upper half of second groove portion 108 on forming end 56. Collet 34 then rotates partially formed tube 40 about the center axis 111 of tube trailing portion 43B so as to move tube leading portion 43A in the direction "B" (FIG. 13). As tube leading portion 43A is thus rotated upwardly, it abuttingly bumps shiftable block 48 out of the way to the raised tube-release position. Movable block 48 pivots about pivot pin 80 on shelf 74 of main block 46 until tube leading portion 43A moves past shiftable block 48. Shiftable block 48 then drops downwardly by gravity to the bend-forming position. During this time, arm 32 is returned to the ready position and tube 40 is subsequently indexed forwardly and/or rotated as necessary to ready tube 40 for the next bend. As shown in FIG. 3, several bends 42 have been formed in tube 40. Also, tube 40 is held as if the last bend 42 has just been completed and the clamp dies 24, 36 have been backed away. Thus, tube 40 is ready to be removed (or indexed to the next location) and arm 32 is ready to be moved to the ready position for the next cycle.

Thus as can be seen, a bending die is provided which facilitates forming multiple 180° bends in a tube in an efficient and time productive manner with a minimum of wasted motion, but which does so in a relatively non-complex fashion and with readily maintainable parts. Further, the parts do not require complex or expensive controls, and operate in a reliable manner but with a minimum of space taken up, thus minimizing interference problems with the free ends of partially formed parts having multiple bends.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows.

1. A bending die for forming a bend of about 180° or more in a tube, the tube having first and second sections with an intermediate section to receive the bend therebetween, comprising:

a center die having opposing sides, one of the opposing sides including a first surface;

a shiftable block movably connected to the center die and including a second surface, the shiftable block being movable between a bend-forming position wherein the first and second surfaces combine to form a first groove for receiving and holding the first tube section while the bend is being formed, and a tube-release position wherein the second surface is positioned remotely from the first surface;

the other opposing side of the center die including an opposing surface opposite the first groove forming a second groove for receiving and holding the second tube section after the bend is formed;

clamp means for holding the shiftable block in the bend-forming position, the clamp means being releasable so that the shiftable block can be moved;

the first and second grooves defining a plane and facing opposing directions so that, after the bend is formed in the tube, the first and second grooves interferingly retain the first and second tube sections in the plane as long as the shiftable block is in the bend-forming position; and the first and second surfaces being positioned on opposite sides of the plane and being open to the plane so that, when the shiftable block is released by the clamp means, the shiftable block can be moved to the tube-release position by moving the first tube section against the second surface to abuttingly move the shiftable block to the tube-release position, thus allowing the first tube section to be moved out of the plane past the first surface; whereby the bent tube can be quickly released from and moved away from the center die or indexed to a position for forming another bend.

2. A bending die as defined in claim 1 wherein the shiftable block is pivotally attached to the center die.

3. A bending die as defined in claim 2 wherein the shiftable block is returned from the tube-release position to the bend-forming position by gravity.

4. A bending die as defined in claim 3 wherein the clamp means for holding the shiftable block in the bend-forming position includes a clamp die, the clamp die being movable into engagement with the center die and the shiftable block to securely hold the shiftable block in the bend-forming position when bending the tube.

5. A bending die as defined in claim 4 wherein one of the shiftable block and the clamp die includes a first lip and the other includes a first rim, the first lip and the first rim being mateably engageable to hold the shiftable block against the center die while the bend is being formed.

6. A bending die as defined in claim 1 wherein the clamp means includes a clamp die, and one of the shiftable block and the clamp die includes a first lip and the other includes a first rim, the first lip and the first rim being mateably engageable to hold the shiftable block against the center die while the bend is being formed.

7. A bending die as defined in claim 6 wherein one of the center die and the clamp die includes a second lip and the other includes a second rim, the second lip and the second rim being mateably engageable, the one first lip or first rim on the clamp die and the one second lip or second rim on the clamp die being spaced apart but fixed relative to each other so that the clamp die forms a C-shaped clamping arrangement which engages the center die and the shiftable block to hold the shiftable block in the bend-forming position on the center die.

8. A bending die as defined in claim 7 wherein the C-shaped clamping arrangement of the clamp die includes a central portion that holds the tube against the center die while the bend is being formed in the tube.

9. A bending die as defined in claim 1 wherein the clamp means includes a clamp die that is adapted to simultaneously hold the tube in place in the groove and also hold the movable block in the bend-forming position while the bend is being formed in the tube.

10. A bending die as defined in claim 9 wherein the groove has a cross sectional shape adapted to receive a tube having a circular diameter.

11. A bending die as defined in claim 1 wherein the opposing sides are connected by a curvilinear bend-forming end having multiple transverse ridges therein, the ridges being adapted to create undulations in the tube along the inner diameter of the bend when the tube is bent, the undulations creating an interference condition between the tube and the center die creating interference to movement of the tube in the plane, but the ridges being aligned with the direction of movement of the shiftable block as the shiftable block is moved toward the tube-release position so that the tube is releasable.

12. A bending die as defined in claim 1 wherein the opposing sides are connected by a curvilinear bend-forming end, the curvilinear bend-forming end and the shiftable block forming a third groove interconnecting the first and second grooves, the third groove being shaped to support the tube when the bend is being formed.

13. A bending die as defined in claim 1 wherein the first groove and the second portion are located at a slight angle so that the tube can be bent slightly beyond 180°, thus allowing the bend to spring back to 180° after being released.

14. A bending die as defined in claim 1 wherein the first groove on the one opposing side has a semicircular cross section and the second surface of the shiftable block forms the upper 90° of the cross-sectional shape of the first groove.

15. A bending die comprising:

a center die having opposing sides and a bend-forming end;

a shiftable block movably mounted to the center die, the shiftable block being movable between a bend-forming position wherein the shiftable block is located along one of the opposing sides and a tube-release position wherein the shiftable block is removed from the one opposing side;

a groove defined in the center die and the shiftable block extending around the opposing sides and the end, the groove being useful for supporting a tube while forming a bend in the tube, the groove defining a plane that divides the groove into a first portion and a second portion;

the shiftable block defining the first portion along the one opposing side and also a part of the first portion on the end so that, with the shiftable block in the bend-forming position, a tube bent around the center die is trapped in the plane, but with the shiftable block in the tube-release position and the bent tube moved a short distance off the end of the center die, the bent tube can be released out of the plane generally in the direction of the shiftable block; and clamp means for holding the shiftable block in the bend-forming position, the clamp means being releasable so that the shiftable block can be moved.

16. A bending die as defined in claim 15 wherein the shiftable block is pivotally mounted to the center die.

17. A bending die ac defined in claim 16 wherein the shiftable block is biased toward the bend-forming position by gravity.

18. A bending die as defined in claim 17 wherein the movement of the shiftable block defines an axis of rotation, and the axis of rotation lies on the plane.

19. A bending die as defined in claim 18 wherein the opposing sides of the center die are at a slight angle to parallel so that the tube can be forced to an over-bend condition so that the tube forms a 180° bend after being released.

20. A bending die as defined in claim 15 wherein the groove extends at least 180° around the center die and is adapted to form a 180° bend in the tube.

21. A bending die for forming a bend of about 180° or more in a tube, the tube having first and second sections with an intermediate section to receive the bend therebetween, comprising:

a center die having opposing sides and a bend-forming end interconnecting the opposing sides, one of the opposing sides including a first surface;

a shiftable block movably connected to the center die and including a second surface, the shiftable block being movable between a bend-forming position wherein the first and second surfaces combine to form a first groove for receiving and holding the first tube section while the bend is being formed, and a tube-release position wherein the second surface is positioned remotely from the first surface, the shiftable block normally returned to the bend-forming position by gravity;

a C-shaped clamp for holding the shiftable block in the bend-forming position and also holding the first tube section against the center die in the first groove, the clamp being movable to a release position so that the shiftable block is movable, the first and second surfaces including first and second rims and the clamp including opposing lips for engaging the first and second ledges to hold the shiftable block in the bend-forming position;

the other opposing side of the center die including an opposing surface forming a second groove for receiving and holding the second tube section after the bend is formed;

the first and second grooves defining a plane and facing opposing directions so that, after the bend is formed in the tube, the first and second grooves interferingly retain the first and second tube sections in the plane as long as the first and second tube sections are in the first and second grooves and the shiftable block is in the bend-forming position; and the first and second surfaces being positioned on opposite sides of the plane so that, when the shiftable block is released by the clamp, the shiftable block can be moved to the tube-release position by moving the first tube section against the second surface to abuttingly move the shiftable block to the tube-release position, thus allowing the first tube section to be moved out of the plane past the second surface; whereby the bent tube can be quickly released from the center die and moved out of the plane.

22. A bending die for forming a bend in a tube comprising:

a center die having opposing sides and a bend-forming end connecting the opposing sides, the opposing sides including grooves defining a plane, the bend-forming end being adapted to form a bend in the tube and the grooves being adapted to support the tube while the bend is being formed, but which grooves create an interference condition trapping the bent tube in the plane defined by the grooves;

a shiftable block pivotally connected to the center die and movable between a bend-forming position where the shiftable block forms an upper part of the groove along one of the opposing sides, and a tube-release position where the shiftable block is removed from the one opposing side; and a clamp die associated with the center die and shiftable block, the clamp die being movable between a clamping position to hold the shiftable block to the center die in the bend-forming position while the tube is being bent, and a release position to release the shiftable block; whereby the bent tube can be released from the interference condition by moving the bent tube against the shiftable block to move same to the tube-release position.

* * * * *

UNITED STATES PATENT AND TRADEMARK OFFICE

CERTIFICATE OF CORRECTION

PATENT NO. : 5,187,963

DATED : February 23, 1993

INVENTOR(S) : Frederick E. Sutton et al.

It is certified that error appears in the above-identified patent and that said Letters Patent is hereby corrected as shown below:

Column 10, claim 17, line 11;
"ac" should be --as--.

Signed and Sealed this

Twenty-ninth Day of March, 1994

Bruce Lehman

*Attest:*

BRUCE LEHMAN

*Attesting Officer*

*Commissioner of Patents and Trademarks*